United States Patent [19]

Ortega

[11] 4,185,333

[45] Jan. 29, 1980

[54] CIRCULATION AND LEVEL CONTROL VALVE

[75] Inventor: Robert Ortega, Fountain Valley, Calif.

[73] Assignee: Purex Corporation, Lakewood, Calif.

[21] Appl. No.: 914,372

[22] Filed: Jun. 12, 1978

[51] Int. Cl.[2] ..... E04H 3/16; E04H 3/18

[52] U.S. Cl. ..... 4/172.15; 4/172.17; 137/433; 137/625.47; 4/172

[58] Field of Search ..... 4/172, 172.15, 172.17, 4/172.18; 137/625.47, 391, 398, 409, 428, 433, 411, 430

[56] References Cited

U.S. PATENT DOCUMENTS

| | | | |
|---|---|---|---|
| 3,528,451 | 9/1970 | Hansen | 137/433 |
| 3,623,165 | 11/1971 | Whittell, Jr. | 4/172.15 |
| 3,739,405 | 6/1973 | Schmidt | 4/172.17 |
| 3,781,925 | 1/1974 | Curtis et al. | 4/172.15 |
| 3,938,553 | 2/1976 | Ortega | 137/625.47 |
| 3,943,580 | 3/1976 | Carter | 4/172.15 |
| 3,997,925 | 12/1976 | Hough | 4/172.17 |
| 4,014,052 | 3/1977 | Wolos | 4/172 |

*Primary Examiner*—Henry K. Artis

*Attorney, Agent, or Firm*—William W. Haefliger

[57] ABSTRACT

Liquid levels are controlled in systems that include different liquid bodies between which liquid circulates. Such bodies may typically include swimming pools and spas.

17 Claims, 2 Drawing Figures

35
36
30
11b
33
34
37
70
47
38
40
41
31
TO PUMP
11a
46
11
56
52
54
53
55
51
FROM FILTER
42
43
32
44
39
49
61
60
63
58
59
68
50

CIRCULATION AND LEVEL CONTROL VALVE

BACKGROUND OF THE INVENTION

This invention relates generally to the control of liquid surface levels or levels in systems that include more than one liquid body; and more specifically concerns the control of liquid surface level in one liquid body to and from which liquid is circulated via lines circulating liquid between a second liquid body and a pump. Typically, such liquid bodies are represented by a relatively small size spa (or waterfall or fountain) and a relatively large size swimming pool.

The water in swimming pools is normally circulated to and from a filter, as via a pump. Recently, spas have come into popular use, and are connected into the pool water circulation system. Such spas are commonly located at a higher level than the pool, and have had to be placed close to the pool so overflow water would fall into or drain into the pool. No way was known, prior to the present invention, to control common circulation in such manner that the spa (or fountain, waterfall or other device) could be located away from the pool, and so that overflow would not occur, and at the same time the water level in the spa could be kept at a different level from that in the pool; more specifically, the simple, efficient structure; mode of operation and results of the present invention were not therefore known.

SUMMARY OF THE INVENTION

It is a major object of the invention to provide a solution to the above and other problems encountered in the described environment. Basically, the environmental system circulates liquid (as for example water) to and from multiple liquid bodies, a pump means and ducting being provided. The invention provides, in this system:

(a) control means associated with one liquid body, and in communication with said liquid ducting, for controlling water circulation to and from said one liquid body in response to changes in the surface level of said one liquid body, (b) said control means including float controlled valving.

As will be seen, the valving typically includes an upper valve to control liquid flow from one liquid body to the system, and a second and lower valve to control liquid flow from the system to the one liquid body, there being a common connection between the valves to displace them simultaneously so as to maintain flow to and from the one liquid body for controlling the surface level thereof. In addition, vacuum breaker and check valves may be associated with the two valves, as will be seen, and all of these may be located within a casing carried exteriorly of a shell or tank wall for the one liquid body, so as not to interfere with use of the latter. At the same time, the level of liquid in the one body may be controlled and maintained above or below the level of water in another system water body.

Another object of the invention is to integrate the above within a system that includes two three-way valves operable to control selective circulation of water to a swimming pool and to a spa, as will be seen.

These and other objects and advantages of the invention, as well as the details of an illustrative embodiment, will be more fully understood from the following description and drawings, in which:

DRAWING DESCRIPTION

DETAILED DESCRIPTION

Figure 1:
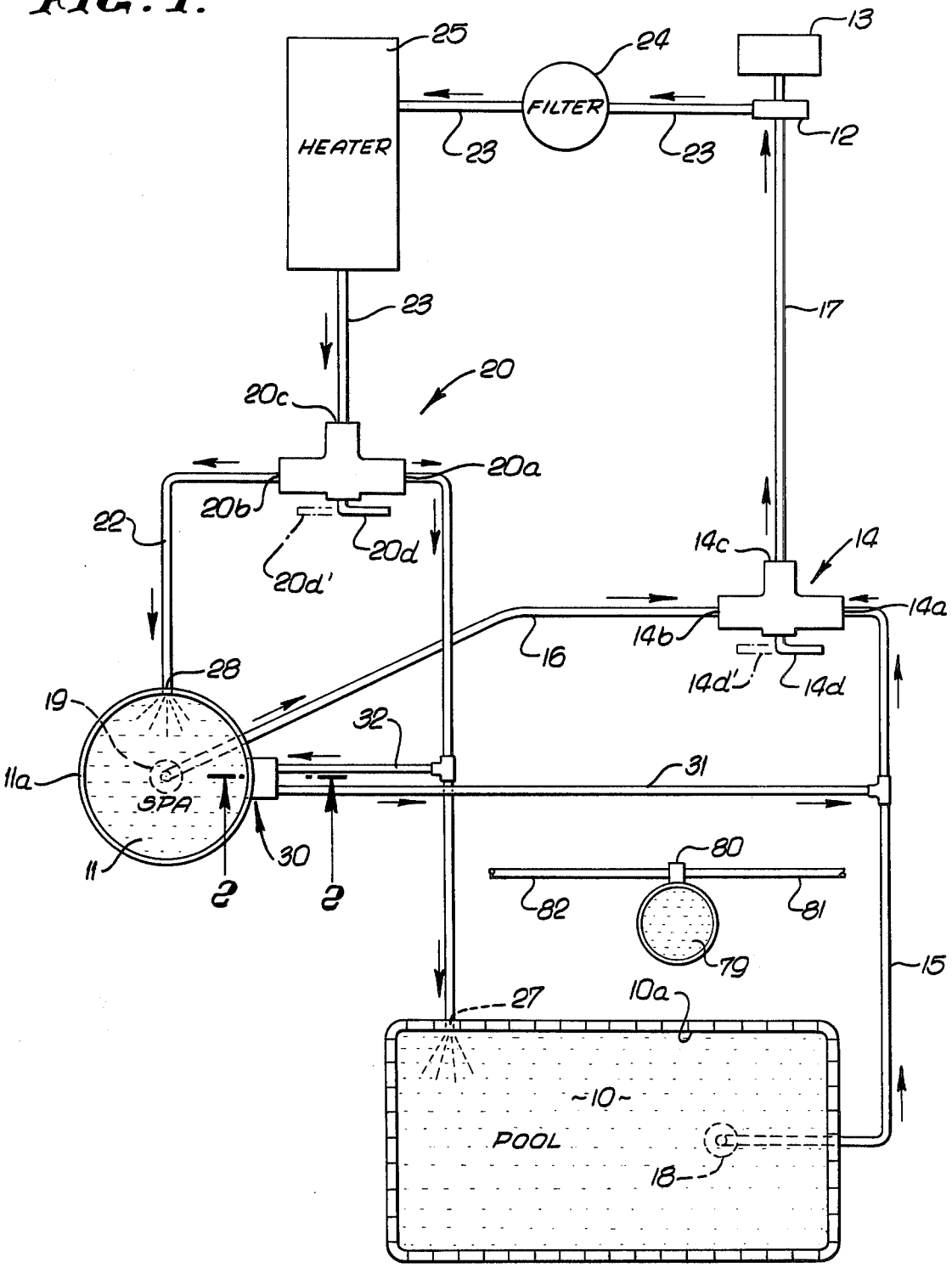
FIG. 1 is a plan view of a system incorporating the invention.

Referring first to FIG. 1, two liquid bodies are shown, and may for example take the form of a swimming pool 10 and a spa 11. The latter may be at a distance from the pool such that no regard is taken for spillage from the spa into the pool; also the water levels of the spa and pool may be different. It will be understood that the spa and pool are representative of different liquid bodies, in a broader sense, and that more than one spa may be employed. The pool wall is indicated at 10*a*, and the spa shell at 11*a*.

A pump is shown at 12, and may be suitably driven by prime mover 13. A first three-way valve 14 is operatively connected with the pool, as via suction line 15, with the spa as via suction line 16, and with the pump intake as via line 17. Corresponding valve ports appear at 14*a*, 14*b*, and 14*c*. Line 15 is connected with pool outlet 18, and line 16 is connected with spa outlet 19. Valve 14 has a control, which may include external handle 14*d* as well as internal stopper structure not shown. That control is movable between a first position (represented by the handle as shown in full lines) in which water is delivered from the pool to the pump via lines 15 and 17 and a second position (represented by the handle broken lines 14*d*') in which water is delivered from the spa to the pump via lines 16 and 17.

A second three-way valve 20 is also operatively connected with the pool, as via delivery line 21, with the spa, as via delivery line 22, and with the pump outlet as via line 23. Corresponding valve ports appear at 20*a*, 20*b* and 20*c*. A filter 24 and heater 25 may be connected in series with line 23, as shown. Line 21 is connected with the pool inlet 27, and line 22 is connected with the spa inlet 28. Valve 20 has a control, which may include external handle 20*d* as well as internal stopper structure not shown. That control is movable between a first position (represented by the handle as shown in full lines) as which water is delivered from the pump to the pool via lines 23 and 21, and a second position (represented by the handle broken lines 20*d*') in which water is delivered from the pump to the spa via lines 23 and 22.

Accordingly, the pool and spa may be independently operated insofar as water circulation is concerned. The two valves 14 and 20 may have the same construction, and may for example take the form of the valve described in U.S. Pat. No. 3,938,553 to Ortega. Other three-way valves may also be employed.

Means is also provided, and operatively connected, to receive water from the second valve for flow to the spa and to receive water from the spa for flow to the first valve, when the two valves are in their described first positions, i.e. when the valves are in pool water circulating mode. Such means may typically include structure responsive to the level of water in the spa to control such water flow to and from the spa in order to maintain that level within a predetermined range. Accordingly, water is then circulated to and from the spa in integrated relation with water circulation to and from the pool, the spa water surface level being independently controlled, whereby the spa will not spill over, and both these water bodies may thus be operated in conjunction with one another to the benefit of users who may select and change their mode of bathing.

Such structure, in accordance with the invention, comprises control means associated with one water body (as for example spa 11) and in communication with water ducting, for controlling water circulation to and from the one water body in response to changes in the surface level of that water body. That control means is generally indicated at 30 in FIG. 1, and as typically having communication via duct 31 with line 15, and as having connection via duct 32 with line 21.

Figure 2:
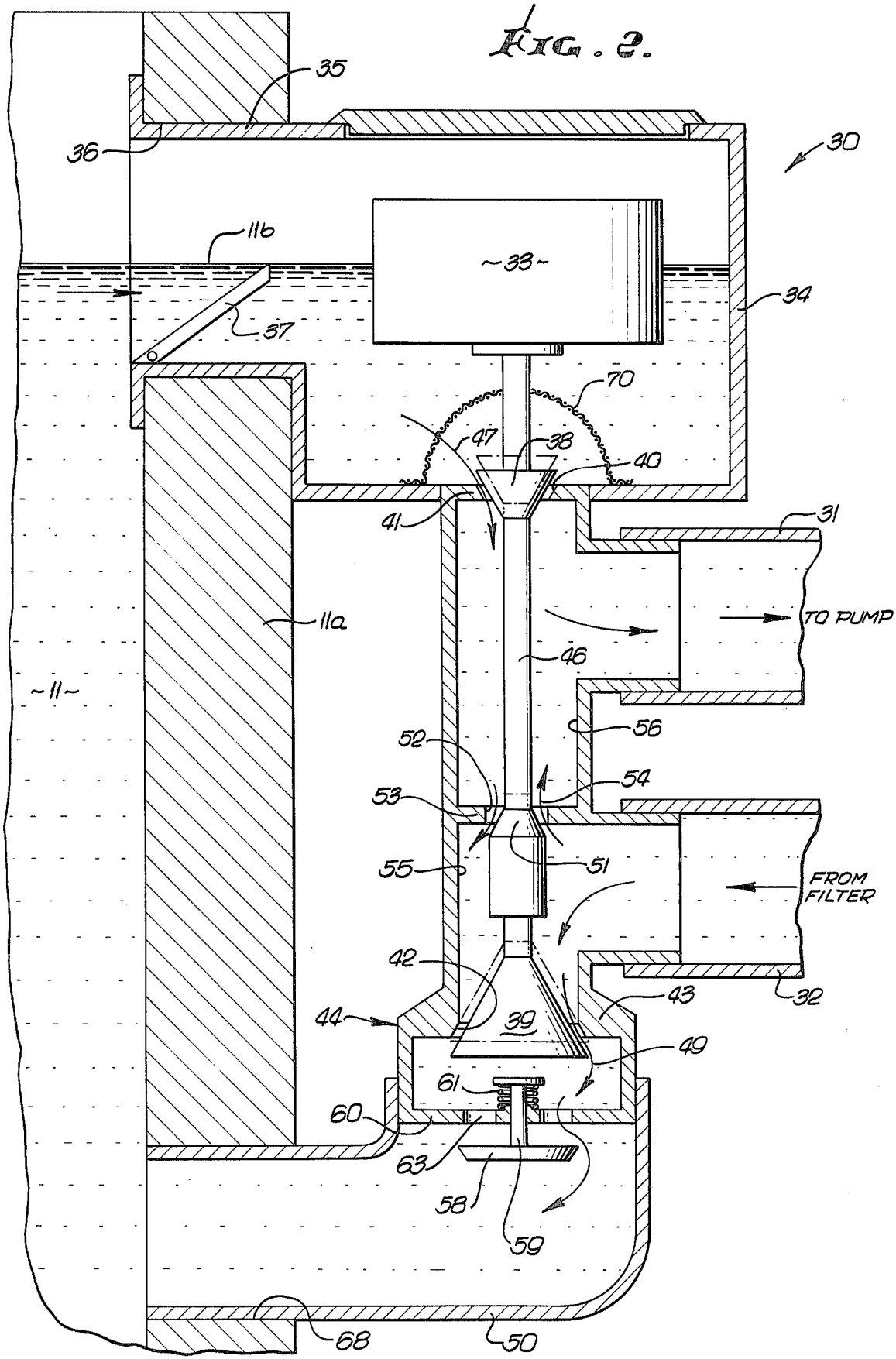
FIG. 2 is an enlarged vertical section taken through control valving.

Extending the description to FIG. 2, the control means 30 typically includes float controlled valving controlled by a float 33 which senses the level of water surface 11*b* in the spa. As shown, the float may be located in a chamber 34 connected at 35 to the spa shell 11*a*, one side opening 36 in the latter providing access of spa water to the interior of the chamber. A weir 37 may be employed, as shown, to prevent access of floating detritus to the chamber interior.

The valving associated with the float may advantageously include upper and lower valves 38 and 39 on a common vertical stem 46 to the upper end of which the float is connected so that the valves and float are simultaneously moved.

An upward facing conical seat 40 is provided in the bottom wall 41 of chamber 34, to seat conical valve 38 as it moves downward; and a downward facing conical seat 42 is provided in upper wall 43 of a lower chamber 44, to seat conical valve 39 as it moves upward. The valves are spaced apart so that as level 11*b* rises, valve 38 moves away from seat 40 to increase outward flow (see arrow 47) from the spa and chamber 34 to line 31, and valve 39 moves toward seat 42 to decrease pressurized supply flow (see arrow 49) to the spa via duct 50. This drops level 11*b*. Conversely, as that level continue to drop, valve 38 progressively closes and valve 39 progressively opens, to increase supply flow to the spa via duct 50. This raises level 11*b*. A controlled level may thereby be achieved. Note screen 70 over the port formed by seat 40, to block flow of small particles to duct 31.

A vacuum breaker conical valve 51 on stem 46 moves toward and away from an opening 52 in a wall 53, forming a restricted passage to by-pass a small portion of the flow (see arrow 54) between sub-chamber 55 and sub-chamber 56. Sub-chamber 55 communicates between duct 32 and chamber 44 (via the port formed by seat 42); and sub-chamber 56 communicates between duct 31 and chamber 34 (via the port formed by seat 40).

A poppet type check valve 58 is associated with chamber 44 to open and pass flow from the chamber or casing structure to the spa, and to close and block reverse flow from the spa to duct 32 (via line 50). Valve 58 is carried by lower wall 60 of chamber 44; it has a stem 59 spring urged upwardly at 61, and bottom wall 60 of the chamber 44 carries the check valve which controls opening 63 in that wall.

It will be noted that the means 30 is typically carried by the wall or shell of the spa, and is located externally thereof, so as not to interfere with use of the spa. Note openings 36 and 68 in wall 11*a*.

It will be further noted that more than one spa may be connected with lines 15 and 21, as for example is indicated in FIG. 1 by second spa 79, lines 81 and 82 (corresponding to lines 31 and 32); and means 80 (corresponding to means 30). Also, the level of water in spas 11 and 79 may be different, yet controlled. Further, water bodies other than a swimming pool and the two spas may be controlled, in the same manner.

I claim:

1. In a system for circulating liquid to and from multiple liquid bodies, the system including pump means and ducting connected with said bodies, the combination which comprises:

(a) control means associated with one liquid body, and in communication with said liquid ducting, which in turn communicates with another of said liquid bodies, for controlling and maintaining water circulation to and from said one liquid body while controlling the level of said one liquid body, in response to changes in the surface level of said one liquid body, (b) said control means including a float and float controlled valving, said float sensing the level of liquid in said one liquid body, (c) said valving including an upper valve to control liquid flow from the one liquid body, and a lower valve to control liquid flow to said one liquid body, there being a common connection to displace said valves simultaneously to maintain flow to and from the one body so as to control the surface level thereof, the valving including seats spaced from the valves and cooperating therewith so as to tend to increase flow past the upper valve when flow past the lower valve is decreased and to decrease flow past the upper valve when flow past the lower valve is increased.

2. The combination of claim 1 including casing structure for said upper and lower valves, and a check valve associated with said structure to open and pass flow from the casing structure to the one water liquid body, and to close and block reverse flow from the one liquid body to the casing structure.

3. The combination of claim 1 including a vacuum breaker valve on the stem, between said upper and lower valves, there being casing structure associated with said valves, and valve seats on said casing structure for said valves.

4. The combination of claim 1 wherein said one liquid body has a water surface level different from the surface level of another liquid body.

5. The combination of claim 4 wherein said one liquid body comprises a spa, and said other liquid body comprises a swimming pool.

6. The combination of claim 1 including said ducting, certain of said ducting communicating said upper valve with a first duct which circulates liquid from another liquid body to the pump, and other of said ducting connecting said lower valve with a second duct which re-circulates liquid from the pump to the other liquid body.

7. The combination of claim 1 including two three-way valves one of which has first, second and third ports communicating respectively with the other liquid body, the pump inlet and the one liquid body, and the other of said three-way valves having first, second and third ports respectively communicating with the other liquid body, the pump discharge, and the one liquid body.

8. The combination of claim 5 wherein the casing structure is carried by a tank for said spa.

9. The combination of claim 8 wherein the casing structure is carried externally of the tank interior.

10. The combination of claim 5 wherein said ducting includes a first duct from the pool discharge to the pump, and a second duct from the pump discharge to the pool inlet, said upper valve communicating with one of said ducts and said lower valve communicating with the other of said ducts.

11. The combination of claim 10 wherein said valves are located exteriorly of a tank containing said one water body.

12. The combination of claim 11 wherein the water levels in said pool and spa are different.

13. For use in a system of the character described, and which includes a swimming pool, a spa and a pump, the combination comprising (a) a first three-way valve operatively connected with the pool, spa and pump, said valve having a control movable between a first position in which water is delivered from the pool to the pump via a first line and a second position in which water is delivered from the spa to the pump via a second line, (b) a second three-way valve operatively connected with the pool, spa and pump, the second valve having a control movable between a first position in which water is delivered from the pump to the pool via the third line, and a second position in which water is delivered from the pump to the spa via a fourth line, (c) and means operatively connected between said third line and the spa and independently of the fourth line to receive water from the second valve for flow to the spa and also operatively connected between the spa and said first line and independently of the second line to receive water from the spa for flow to the first valve when the two valve controls are in said first position, said means including structure for automatically controlling the spa water surface level independently of the pool water surface level, while water also flows between the pool and said pump via said first and third lines.

14. The combination of claim 13 wherein said means includes structure responsive to the level of water in the spa to control said water flow to and from the spa to maintain said level within a predetermined range.

15. The combination of claim 14 wherein said means includes an upper valve to control water flow from the spa, and a lower valve to control water flow to the spa, said valves being interconnected to move simultaneously up and down, casing structure associated with said upper and lower valves, and valve seats on said structure.

16. The combination of claim 13 wherein the spa water surface level as controlled by said means is different than the pool water surface level.

17. The combination of claim 13 including a heater connected between said two three-way valves to heat water delivered to the spa and pool.

* * * * *